US005235782A

United States Patent [19]

Landau

[11] Patent Number: 5,235,782

[45] Date of Patent: Aug. 17, 1993

[54] COVER FOR POTTED PLANTS AND METHOD FOR COVERING POTTED PLANTS

[76] Inventor: Simcha Landau, 71 Garwood Rd., Fair Lawn, N.J. 07410

[21] Appl. No.: 799,395

[22] Filed: Nov. 27, 1991

[51] Int. Cl.[5] ..... A01G 9/02

[52] U.S. Cl. ..... 47/72; 47/84; 47/66

[58] Field of Search ..... 47/72, 66, 84; 229/89, 229/4.5; 215/12.1

[56] References Cited

U.S. PATENT DOCUMENTS

| | | | |
|---|---|---|---|
| 2,540,707 | 2/1951 | Beukelman | 47/72 |
| 2,834,153 | 5/1958 | Fearn | 47/66 |
| 3,962,503 | 6/1976 | Crawford | 47/72 |
| 4,137,668 | 2/1979 | Kojo | 47/66 |
| 4,413,725 | 11/1983 | Bruno et al. | 47/72 |
| 4,508,223 | 4/1985 | Catrambone | 47/72 |
| 4,950,216 | 8/1990 | Weder | 47/72 |
| 4,980,209 | 12/1990 | Hill | 47/66 |
| 5,111,613 | 5/1992 | Weder et al. | 47/72 |

FOREIGN PATENT DOCUMENTS

| | | | |
|---|---|---|---|
| 2419234 | 11/1979 | France | 47/66 |
| 2481881 | 11/1981 | France | 47/66 |
| 560532 | 4/1975 | Switzerland | 47/72 |

*Primary Examiner*—Carl D. Friedman
*Assistant Examiner*—Joanne C. Downs
*Attorney, Agent, or Firm*—W. Patrick Quast

[57] ABSTRACT

An improved cover for potted plants and method for covering potted plants is described. The cover provides a water tight seal at its base while at the same time protecting the plant from contact with water leaking out of the plant. The cover is in the form of a flat, tear-away bag that customers of florists and plant nurseries can use themselves without assistance.

13 Claims, 3 Drawing Sheets

COVER FOR POTTED PLANTS AND METHOD FOR COVERING POTTED PLANTS

BACKGROUND OF THE INVENTION

This invention relates to wrapping plants for purposes of display and transportation, and in particular to covering potted plants for such purposes.

Florists, plant nursery professionals, and the like, have a variety of means at their disposal for wrapping potted plants in an attractive fashion. The coverings must be easy to use, relatively economical, convenient for customers to carry after they have made a purchase, and present the potted plants in an inviting manner. Currently preformed potcovers are available that are leakproof, and can be obtained in a variety of colors and sizes to accommodate pots for plants of varying dimensions. Additionally a preformed plastic wrapping has been disclosed by Daniel Lapalud in French Patent No. 8809110 (filed Jun. 30, 1988— issued Jan. 5, 1990).

While these wrappings provide and suggest useful conveniences in the merchandising of potted plants, the instant invention offers important additional improvements. Present wrappings either have their base open to permit moisture to drain away from the plant, or provide a leak proof seal at the base. In the former case moisture can be messy during storage and transport, and in the latter case water collecting at the base of the plant can cause vegetation to rot. And preformed potcovers have the disadvantage of being restricted to pots for plants of specific sizes. Also preformed covers tend to be bulky to store in large quantities.

The instant invention addresses these problems, and provides additional conveniences including accommodating a variety of pot dimensions in a particular size covering, built-in means for gripping the covering, means for including a greeting card within the cover, and means for securing large quantities of the covering to a hanger from which the covering can be easily torn away. Further, the aesthetic qualities of the covering are improved by having the cover laminated, with a decorative edge, such as a fluted edge.

SUMMARY OF THE INVENTION

A primary object of the invention is to provide a covering for potted plants to aid in the prevention of rotting of the plant due to contact with excess water.

A further object is to provide a convenient tear-away potted plant cover.

An additional object is to accommodate a variety of sizes of potted plants in a single covering.

Another object is to provide means for conveniently transporting potted plants.

A further object is to provide attractive, easily storable potted plant covers with means for holding and displaying a greeting card.

These and other objects are obtained with this improved covering for potted plants and method for covering potted plants.

In the instant invention a potted plant cover is formed in the shape of a bag, with an open top portion and a sealed base portion. The open top portion extends approximately half of the total length of the bag, being generally conically shaped, with the base portion of the bag being generally cylindrical in shape. This bag can be made out of a variety of materials such as paper, plastic, aluminum foil, etc., but is preferably made out of a suitable plastic, which can, of course, be laminated for decorative purposes.

The bag is preferably supplied flat with additional material being folded to extend within the base portion of the bag. This folded additional material is sealed at its bottom edge, so that the base portion of the bag provides a liquid seal when a potted plant is placed therein. This folded additional material within the base portion of the bag can be provided in a variety of shapes, the preferred shape being in the form of a "gusset", i.e. an additional triangular piece of material. The function of this gusset is two-fold; to provide for comfortably accommodating a number of differently sized cylindrically shaped potted plants, while at the same time providing a void area at the periphery of the base portion of the bag, away from the base of the potted plant. Water draining out of the potted plant will drain into this void area, away from the plant, and thereby prevent rotting of the plant vegetation which may occur if the water were permitted to remain in contact with the base of the plant.

The bag is also provided with additional material connected to the outwardly extending portion of the cone shaped top portion. This top portion additional material is connected to the top portion of the bag in a manner that will facilitate tearing the top portion of the bag, and hence the entire bag, away from this top portion additional material. This top portion additional material is connected to the rest of the bag by means of a weakened tear line, a perforated line, etc. Holes may be provided in this top portion additional material, so that is may be secured on a hanger, or hanging posts. In this manner large quantities of these bags can be made accessible to customers of florists and plant nurseries, enabling said customers to help themselves to a plant covering when they have made a selection of a potted plant to purchase. The tear line connecting this top portion additional material to the rest of the bag is preferably arranged so that when the bag is torn away a decorative edge is formed at the outwardly flaring conical edge of the top portion of the bag, as, for example, a fluted edge.

A hand grip cut out in opposite faces of the top portion of the bag is provided, so that customers can conveniently carry the selected potted plant. Additionally, when the conical top portion of the bag is folded down for full viewing of the plant, a slot for holding a greeting card is provided. The bag is preferably made in a laminated plastic to facilitate a metal foil appearance, for printing directly on the bag, and for other decorative techniques.

DETAILED DESCRIPTION OF THE PREFERRED EMBODIMENTS

Figure 1:
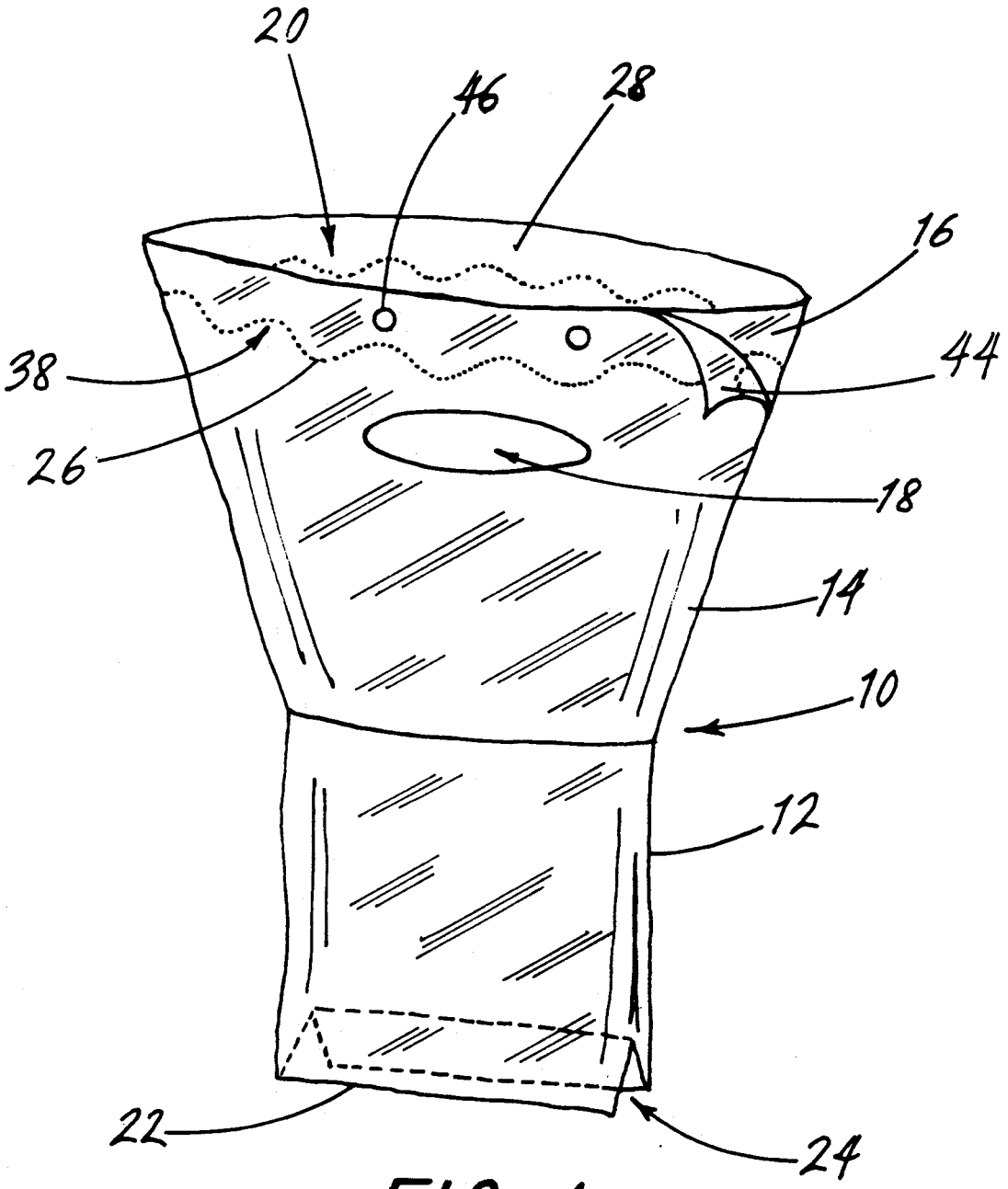
FIG. 1 is a perspective view of the improved cover for potted plants of the invention showing a laminated construction, and the gusset portion of the cover shown in phantom.
Figure 2:
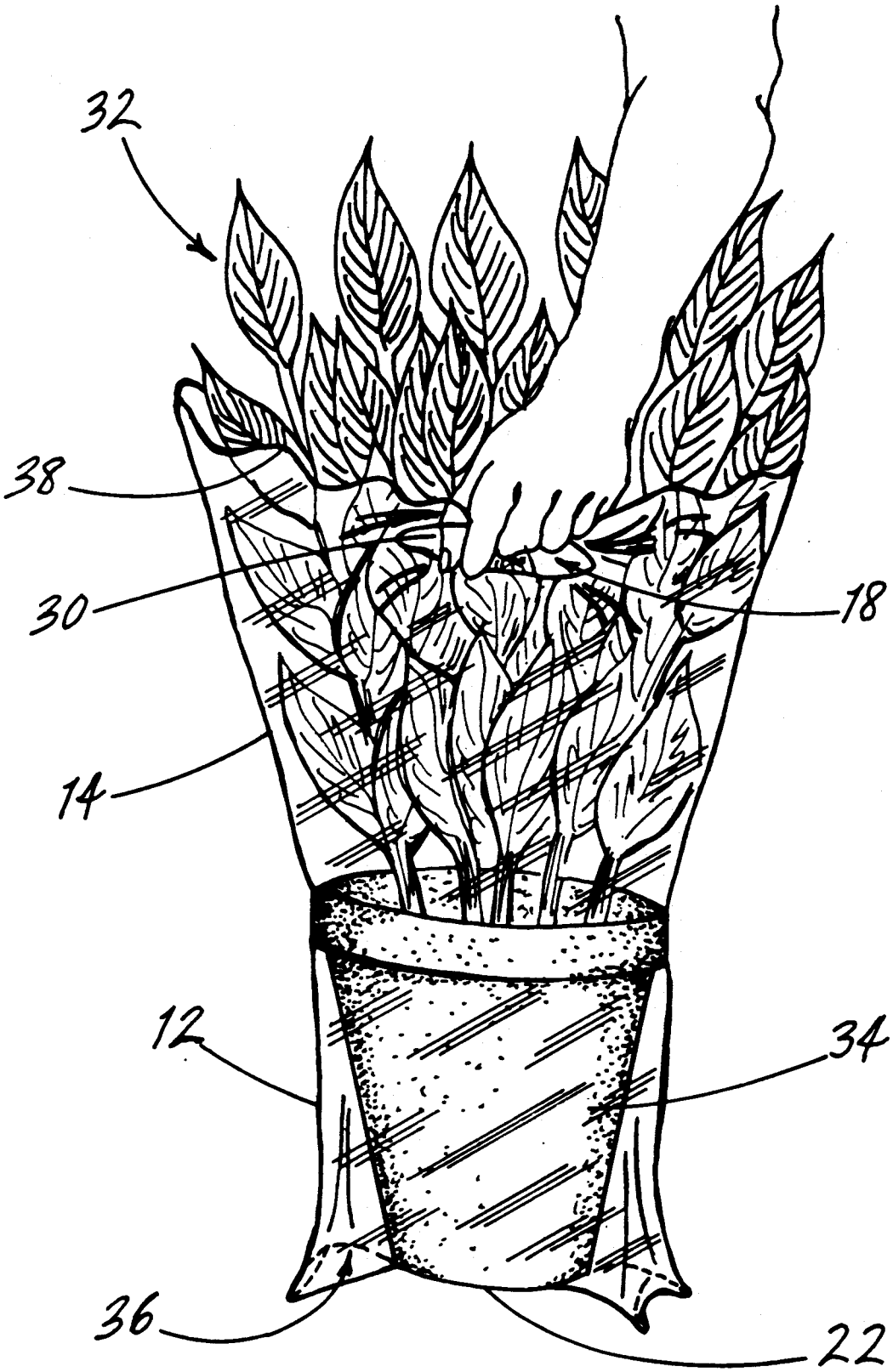
FIG. 2 is a perspective view of the cover of the invention showing ease of transport, with a potted plant secured in the cover illustrating the void area developed by the gusset at the base of the cover.

Referring now to FIG. 1 a preferred embodiment of the cover of the invention is shown. The cover is shown in the shape of a bag 10 with a top portion 14, and a base portion 12. Bag 10 can be fabricated in a variety of ways, as, for example, from paper, plastic, aluminum foil, etc. Preferably bag 10 is made in one piece, and is supplied flat for ease in storage and handling. When in use, the top portion 14 of bag 10 has an open end 20, and the base portion 12 is sealed at the bottom edge 22 of gusset 24. The top portion 14 is generally conical in shape, flaring outward towards said open end 20 of top portion 14. A cut out 18 is provided in top portion 14, and an identical cut out (not shown) in the opposite wall of top portion 14 provides a hand grip 30 (FIG. 2) for bag 10 when a potted plant 34 (FIG. 2) is secured within said bag.

Top portion 14 has additional material 28 initially connected to the open end 20 of top portion 14. This additional material 28 is weakly connected to top portion 14 at tear line 26. This tear line goes completely around the circumference of the open end 20 of bag 10. The tear line 26 can be made with perforations along its circumference or by other well known means for weakening this connection of additional material 28 to top portion 14. Holes 36 and 46 provide a convenient way for securing bag 10 to a hanger (not shown), or hanging posts (not shown). In actual use the bag can be place on said hanger in large quantities since said bag is supplied flat. Customers having selected a potted plant for purchase can then simply tear away bag 10 from said hanger leaving additional material 28 behind on the hanger. Additionally, the means for causing the weak connection of additional material 28 to top portion 14 can be arranged in a manner to cause the tear to form a decorative edge at the open top of top portion 14, as, for example, a fluted edge 38.

Base portion 12 of bag 10 is generally cylindrical throughout its length, comprising approximately half the length of complete bag 10. Bend line 28 forms the junction between top portion 14 and base portion 12. Additional material which can be added in the shape of a gusset 24 (i.e. an additional triangular piece of material), extends within base portion 12 of bag 10. Bottom edge 22 of gusset 24 forms the liquid seal for bag 10. In actual use the gusset serves the double function of comfortably accommodating a variety of sizes of a cylindrically shaped plant container 34 (FIG. 2), while at the same time providing a void area 36 (FIG. 2) at the periphery of the bottom of base portion 12. When plant container 34 together with plant 32 is placed within bag 10, the base of plant container 34 contacts the bottom edge 22 of gusset 24 so that gusset 24 expands outwardly and downwardly to accommodate the base of plant container 34, and void area 36 is created at the periphery of the bottom of base portion 12. Water (not shown) that may drain out of plant 32 and container 34 is now free to drain away from the base of container 34, thereby protecting plant 32 from rot that might occur if said plant remained in contact with said water.

Figure 3:
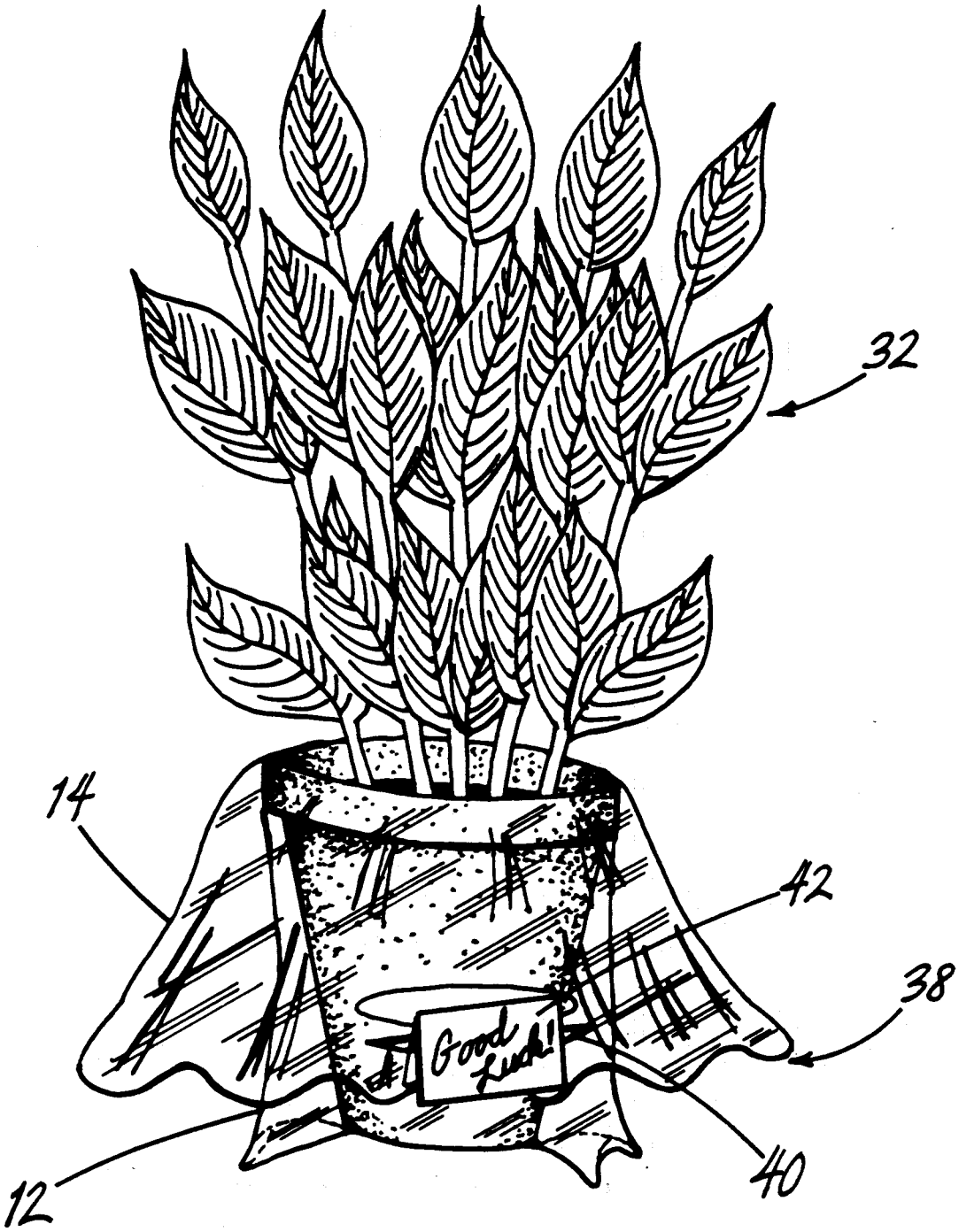
FIG. 3 is a perspective view of the cover of the invention, with the top portion pulled down to show the potted plant, illustrating the placement of a greeting card within a slot in the top portion of the cover.

FIG. 3 illustrates placing a greeting card 42 within a slot 40 in the inner surface of top portion 14 of bag 10. When the open end 20 is folded down over base portion 12 slot 40 becomes visible. A greeting card 42 previously placed within slot 40 now becomes visible and accessible.

Fabricating bag 10 as a plastic laminate, with an outside layer 44 (FIG. 1) and an inside layer 16 (FIG. 1) permits printing informative material, and decorations directly on the surface of the bag.

As can be understood from the foregoing bag 10 provides an attractive and useful cover and method for displaying, protecting, and transporting potted plants.

While the present invention has been disclosed in connection with the preferred embodiments shown and described in detail, various modifications and improvements thereon will become readily apparent to those skilled in the art. Accordingly, the spirit and scope of the present invention is to be limited only by the following claims:

What is claimed is:

1. A cover for a plant holding container, which comprises:

(A) Said cover being in the shape of a bag, said bag being collapsible to a substantially flat position;

(B) Said bag having a top portion and a base portion, with the top edge of said top portion being open, and the bottom edge of said base portion being closed;

(C) Said top portion of said bag being generally conical in shape, with the narrow portion of said conical shape being connected to said base portion of said bag, said top portion non-detachably connected to said base portion, said top portion adaptable to be folded down and over said base portion revealing the inner surface of said top portion;

(D) Said base portion of said bag being generally cylindrical in shape; and (E) Said closed bottom edge of said base portion of said bag being closed with an additional piece of material, said additional piece of material extending upwardly inside of said base portion of said bag, said additional material being collapsible to a substantially flat position, so that when said plant holding container is placed within said bag a void area is created at the periphery of the bottom of said bag by the downward and outward expansion of said additional piece of material, and water draining from a plant within said plant holding container collects within said periphery of said bottom of said bag.

2. The cover according to claim 1 wherein said additional piece of material within said base portion of said bag is in the shape of a gusset.

3. The cover according to claim 1 wherein said top portion of said bag has two cut out portions, said cut out portions being opposite to each other, said cut out portions being sufficiently large to permit gripping said bag.

4. The cover according to claim 1 wherein said top edge of said top portion of said bag further comprises additional material which is easily separable from said top portion.

5. The cover according to claim 4 wherein said easily separable additional material contains means for enabling said bag to be connected to a hanger.

6. The cover according to claim 3 further comprising pocket means for placement of a greeting card within the inner surface of said top portion, so that when said top portion is folded down and over said base portion, said greeting card, having been previously placed therein, becomes visible and accessible.

7. The cover according to claim 4 wherein when said easily separable additional material is separated from said top edge of said top portion of said bag, a preselected pattern within said top edge is revealed.

8. The cover according to claim 1 wherein said bag is fabricated in plastic.

9. The cover according to claim 8 wherein said bag is fabricated in at least two layers of plastic.

10. The cover according to claim 4 wherein said bag is substantially flat prior to being used.

11. A method for covering a potted plant and the container for said potted plant, which comprises the steps of:

placing said container within a cover, said cover being in the shape of a bag, said bag being collapsible to a substantially flat position, including as part of said bag additional material collapsible to a substantially flat position for preventing rotting of said plant that would occur if said base of said plant remained in contact with water draining from said plant by allowing said water within said plant to drain away from said plant and collect in void areas within said additional material and, provisioning said bag with a base portion and top portion non-detachably connected to said base portion, said base portion being generally cylindrical in shape, the top edge of said top portion being open and the bottom edge of said base portion being closed, said additional material closing the bottom edge of said base portion and extending upwardly inside of said base portion of said bag, said top portion of said bag being generally conical in shape, with the narrow portion of said conical shape being connected to said base portion of said bag, said top portion adaptable to be folded down and over said base portion revealing the inner surface of said top portion.

12. A method according to claim 11 further comprising the step of transporting said container by gripping said bag covering said container.

13. A method according to claim 11 further including the steps of hanging up said bag, and separating said bag from material at the top portion of said bag by tearing said bag away from said material prior to placing said container within said cover.

* * * * *